US009340400B2

(12) United States Patent
Chong et al.

(10) Patent No.: US 9,340,400 B2
(45) Date of Patent: May 17, 2016

(54) LOAD LIFTING ASSEMBLY

(71) Applicant: UNIVERSITI BRUNEI DARUSSALAM, Gadong (BN)

(72) Inventors: Kim Onn Chong, Gadong (BN); Isyrah Fahmi Osman, Gadong (BN); Lim Ren Foo, Gadong (BN)

(73) Assignee: UNIVERSITI BRUNEI DARUSSALAM, Gadong (BN)

( * ) Notice: Subject to any disclaimer, the term of this patent is extended or adjusted under 35 U.S.C. 154(b) by 322 days.

(21) Appl. No.: 14/193,152

(22) Filed: Feb. 28, 2014

(65) Prior Publication Data

US 2014/0246273 A1 Sep. 4, 2014

(30) Foreign Application Priority Data

Mar. 1, 2013 (BN) ..... 2013/0035

(51) Int. Cl.

| | |
|---|---|
| ***B66B 9/00*** | (2006.01) |
| ***B66F 9/08*** | (2006.01) |
| ***B66F 7/02*** | (2006.01) |

(52) U.S. Cl.

CPC .... *B66F 9/08* (2013.01); *B66F 7/02* (2013.01)

(58) Field of Classification Search

CPC ..... B66F 9/08; B66F 7/02

USPC ..... 187/262

See application file for complete search history.

(56) References Cited

U.S. PATENT DOCUMENTS

| | | | | | |
|---|---|---|---|---|---|
| 1,338,127 | A * | 4/1920 | Felt | B66F 9/02 | 187/241 |
| 1,695,674 | A * | 12/1928 | Wilson | B63H 9/08 | 114/112 |
| 4,684,310 | A * | 8/1987 | Stange | B60B 29/001 | 187/207 |
| 4,987,976 | A * | 1/1991 | Daugherty | B66B 9/16 | 16/331 |
| 5,749,313 | A * | 5/1998 | Shackelford, Jr. | B66C 3/06 | 114/48 |
| 5,803,003 | A * | 9/1998 | Vickers | B66F 7/02 | 114/44 |
| 6,640,934 | B1 * | 11/2003 | Edwards | B66B 9/00 | 182/141 |
| 7,213,526 | B1 * | 5/2007 | Hamilton | B63C 3/06 | 114/44 |
| 8,684,654 | B2 * | 4/2014 | Bardin | B60B 30/02 | 187/231 |
| 2005/0077112 | A1 * | 4/2005 | Ehrenleitner | B66F 7/02 | 187/261 |
| 2006/0023979 | A1 | 2/2006 | Liedmann et al. | | |
| 2012/0018688 | A1 | 1/2012 | Finkbeiner | | |

FOREIGN PATENT DOCUMENTS

| | | |
|---|---|---|
| CN | 101045515 A | 10/2007 |
| GB | 692389 A | 6/1953 |
| JP | 2007-8696 A | 1/2007 |

* cited by examiner

*Primary Examiner* — William A Rivera
*Assistant Examiner* — Michael Riegelman
(74) *Attorney, Agent, or Firm* — Geeta Kadambi; Riddhi IP LLC

(57) ABSTRACT

The invention relates to a load lifting assembly to lift and transport the loads. The assembly comprises a fixed pole and a lifting unit capable of moving longitudinally along the pole. The assembly further comprises a load transporting unit coupled to the lifting unit and a driving unit to provide the motive force to the load transporting unit.

16 Claims, 6 Drawing Sheets

LOAD LIFTING ASSEMBLY

FIELD OF THE INVENTION

The present invention relates to an assembly to lift and transport loads.

BACKGROUND OF THE INVENTION

Lifting and transportation of loads from one place to another is a regular routine in various industries including textile, mechanical, civil, cargo, automotive, the plastic industry, the woodworking industry, the foodstuffs industry and the drinks industry. Load lifting ventures involves transporting loads manually or with the help of load lifting devices. The task of carrying loads of various shapes, sizes and weights manually by laborers is a physically challenging and time consuming process.

There are various assemblies available in the prior art for lifting purposes like an assembly having clamping jaws connected by a rod and moving on a column, the lower jaw carries the load and the upper jaw is connected through a lever to an operating lever which is reciprocated to cause the load to climb the column, the jaws gripping the column alternately. Springs urge the jaws to the clamping position. The load may be raised either by inserting a lever between the jaws or for heavier loads a lever is pivoted to the lower jaw and contacts a roller on the upper jaw. Another assembly concerns a linear sliding guide comprising a shaped rail which extends in the longitudinal direction having sliding surfaces, and a slider which is axially displaceable on the sliding surfaces of the shaped rail and has sliding bearings which bear against the sliding surfaces.

The assemblies available in the prior art have a fixed load carrying capacity and their overall structure utilizes a lot of workspace. Another drawback is that these assemblies are difficult to assemble, mount and require a lot of maintenance. Also, they lack the flexibility in terms of lifting the loads of various sizes and are expensive to manufacture. Further, they exhibit a lot of friction which hampers their performance.

Thus, there is a need for a new assembly for lifting and transporting the loads which are easy to assemble, to mount, is flexible, inexpensive to manufacture and that can be used in a variety of operations depending upon the type of loads being lifted.

SUMMARY OF THE INVENTION

It is an object of the invention to provide a load lifting assembly for lifting and transporting the loads.

It is another object of the invention to provide a load lifting assembly comprising a fixed pole, a lifting unit, a load transporting unit and a driving unit. The lifting unit comprises a plurality of bars and a plurality of bearings mounted laterally on the bars, wherein the bearings contact the pole. The lifting unit further comprises a plurality of first screws in a first plane, a plurality of second screws in a second plane wherein the first plane and the second plane cross each other. A pair of first connectors is connected proximately to the opposite ends of each of the first screws and a pair of second connectors is connected proximately to the opposite ends of each of the second screws. The lifting unit is coupled with the load transporting unit and is being driven longitudinally along the pole by the driving unit.

It is still another object of the invention to provide a load lifting assembly in which the contact pressure of the bearings contacting the pole is adjustable.

It is still another object of the invention to provide a load lifting assembly in which the first and the second connectors act as a framework for supporting the plurality of bars and the framework is capable of adjusting the contact pressure of the bearings contacting the pole.

It is still another object of the invention to provide a load lifting assembly in which the driving unit is selected from the group comprising of electrical, pneumatic, hydraulic and mechanical units.

It is still another object of the invention to provide a load lifting assembly which is easy to assemble.

It is still another object of the invention to provide a load lifting assembly comprising materials having low cost and easy availability.

It is still another object of the invention to provide a load lifting assembly that can be applied to wide range of industries where lifting and transportation of a load is required, such as various ports for loading goods, cargo handling in airport, textile, in supermarkets, mechanical, civil, cargo, automotive, the plastics industry, the woodworking industry, the foodstuffs industry and the drinks industry or the like.

It is still another object of the invention to provide an assembly comprising a fixed pole and a movable unit capable of moving longitudinally along the pole. The movable unit comprises a plurality of bars and a plurality of bearings mounted laterally on the bars, wherein the bearings contact the pole. The movable unit further comprises a plurality of first screws in a first plane, a plurality of second screws in a second plane, a pair of first connectors connected proximately to the opposite ends of each of the first screws and a pair of second connectors connected proximately to the opposite ends of each of the second screws. The first plane and the second plane cross each other.

It is a still another object of the invention is to provide a low cost assembly which is quite flexible in nature and all its parts can be replaced. There are various configurations possible in the assembly of the invention depending upon the type and weight of the load being lifted and transported. The different size of bearings and bars can be used for lifting heavier or lighter loads. The number of bearings used can be increased to improve the functionality of this unit. Various types of materials but not limited to steel, stainless steel, aluminum or other materials can be used to manufacture the components of the assembly to create a superior and strong assembly. The Screws can be replaced with high tensioned screws allowing better stability. All these modifications can be done without altering the scope of the invention.

BRIEF DESCRIPTION OF THE DRAWINGS

Embodiments of the present invention hereinafter described in conjunction with the appended drawings are provided to illustrate and not to limit the present invention, wherein like designations denote like elements, and in which.

DETAILED DESCRIPTION OF THE INVENTION

In the detailed description of the present invention, numerous specific details are described to provide a thorough understanding of the various embodiments of the present invention. However, a person skilled in the relevant art will recognize that an embodiment of the present invention can be practiced without one or more of the specific details, or with other apparatuses, systems, assemblies, methods, components, materials, parts, and/or the like. In other instances, well-known structures, materials, or operations are not specifically shown or described in detail to avoid obscuring aspects of embodiments of the present invention.

Figure 1:
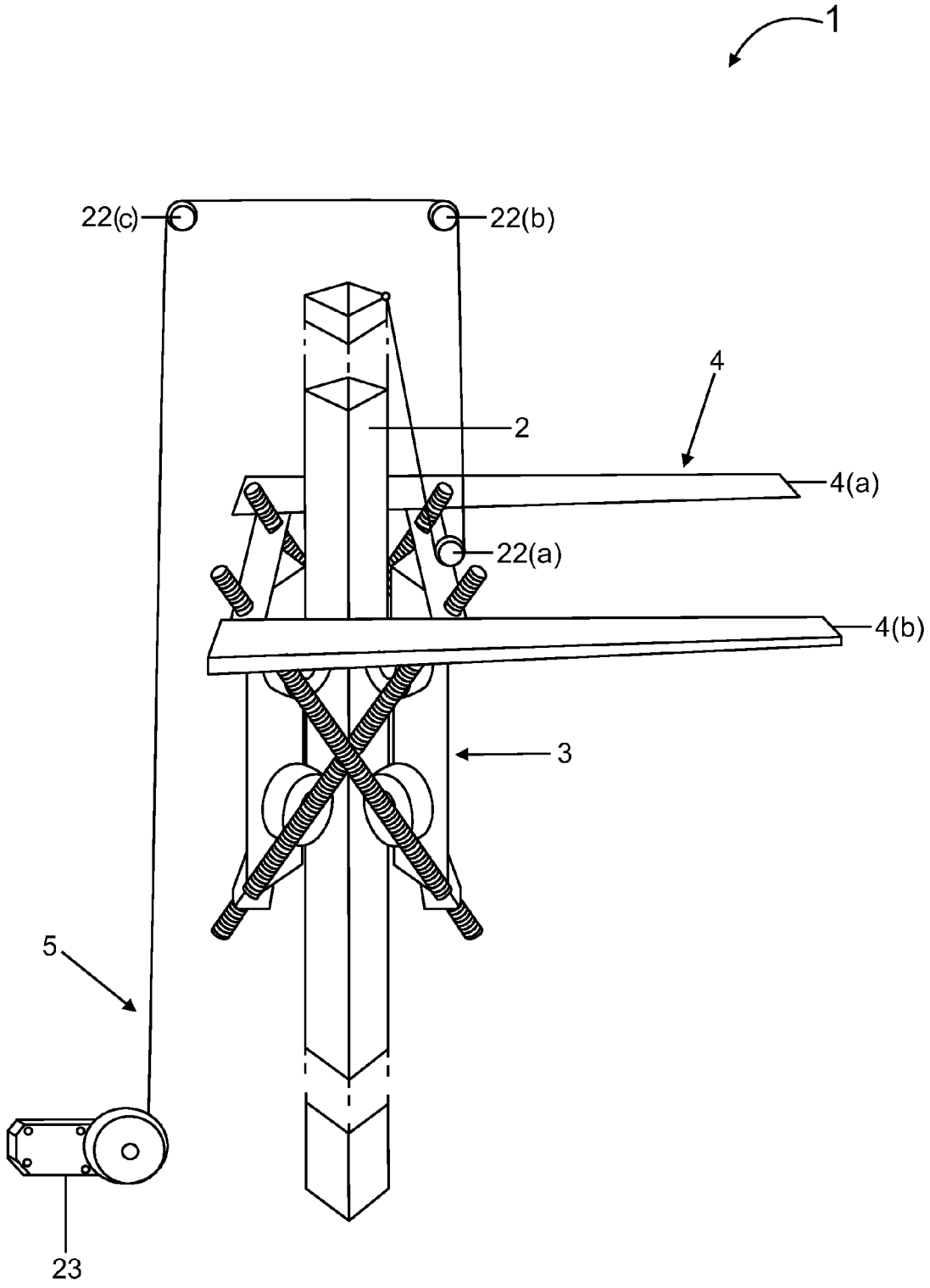
FIG. 1 illustrates the load lifting assembly of the invention.

The invention relates to a load lifting assembly 1 as illustrated in FIG. 1. The load lifting assembly 1 comprises a pole 2, a lifting unit 3, a load transporting unit 4 and a driving unit 5. Preferably, the pole 2 has a diamond shape and is fixed at its base.

Figure 2:
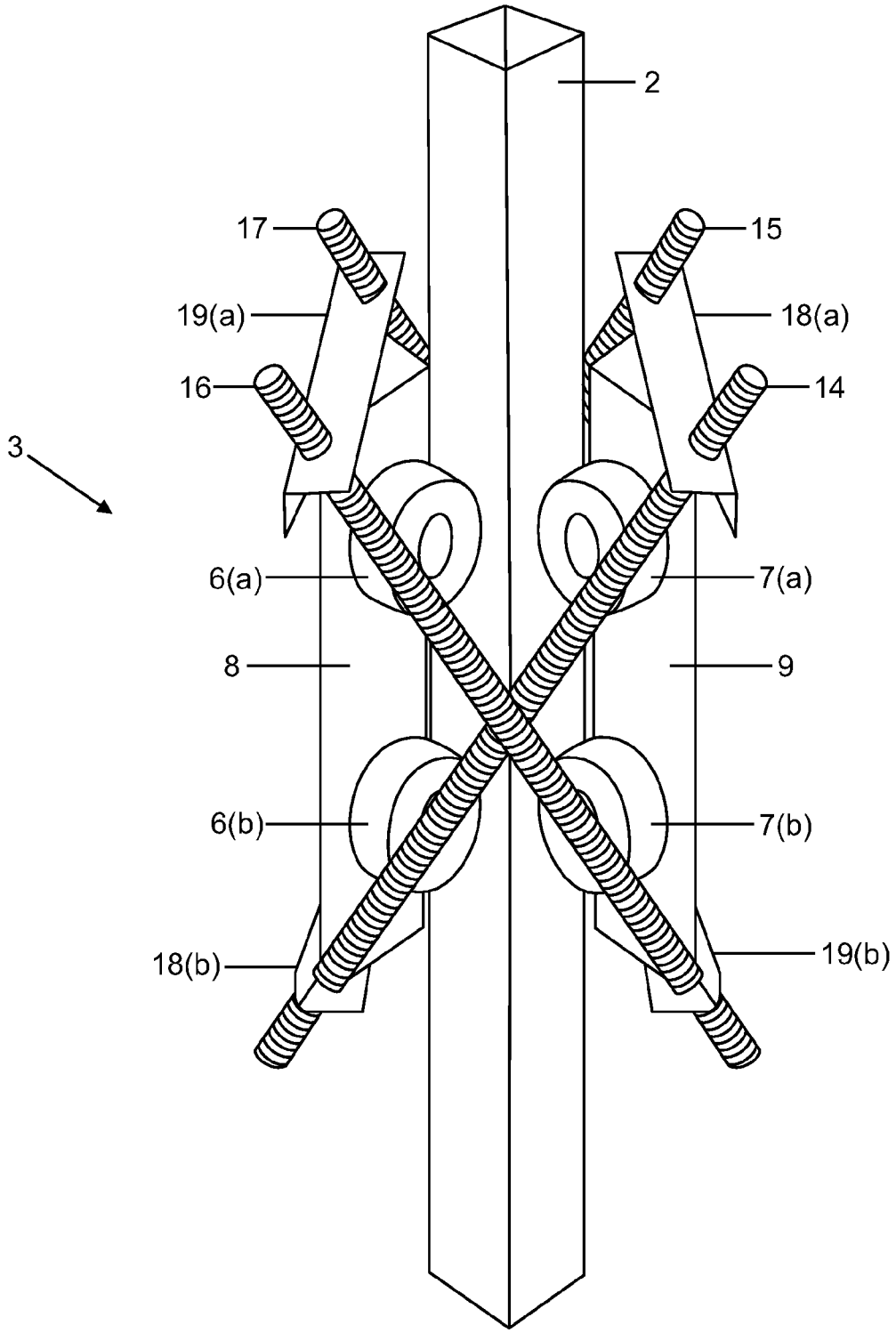
FIG. 2 illustrates the lifting unit mounted on the pole.

As illustrated in FIG. 2, the lifting unit 3 comprises a plurality of bars 8, 9 and a plurality of bearings 6(*a*), 6(*b*), 6(*c*) (not shown), 6(*d*) (not shown), 7(*a*), 7(*b*), 7(*c*) (not shown), 7(*d*) (not shown). The bearings 6(*a*), 6(*b*), 6(*c*), 6(*d*) are mounted laterally on the bar 8 and the bearings 7(*a*), 7(*b*), 7(*c*), 7(*d*) are mounted laterally on the bar 9. Further, all the eight bearings 6(*a*), 6(*b*), 6(*c*), 6(*d*), 7(*a*), 7(*b*), 7(*c*), 7(*d*) are in contact with the pole 2.

Figure 3:
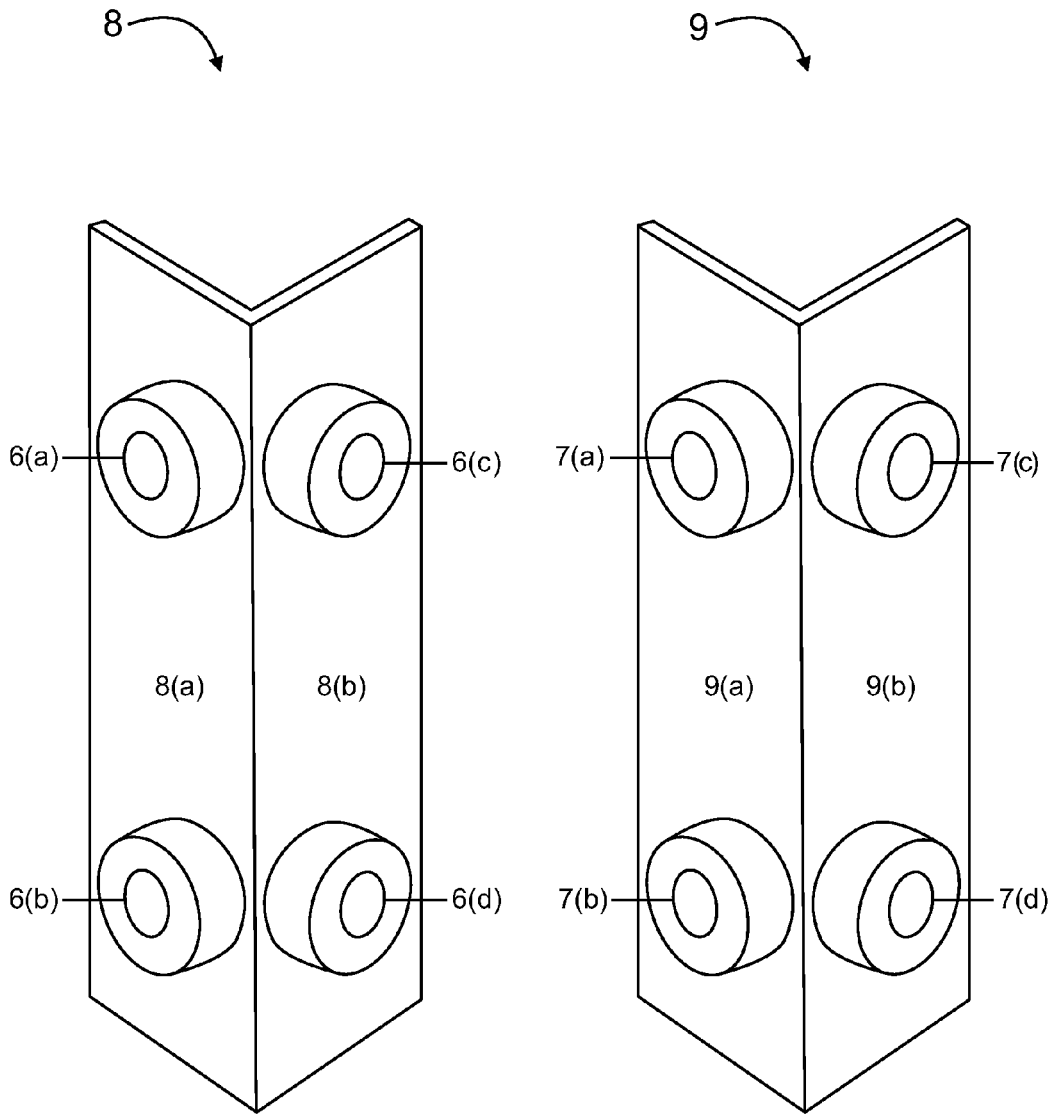
FIG. 3 illustrates the perspective view of the angle bars with mounted bearings.

In one embodiment of the invention, the bars 8, 9 are angle bars. FIG. 3 depicts the individual configuration of the angle bars 8, 9 installed in the lifting unit 3. The angle bar 8 comprises four bearings 6(*a*), 6(*b*), 6(*c*), 6(*d*) mounted laterally on its two angled surfaces 8(*a*) and 8(*b*). The two bearings 6(*a*), 6(*b*) are mounted on the angled surface 8(*a*) and two bearings 6(*c*), 6(*d*) are mounted on the angled surface 8(*b*). Similarly, the angle bar 9 comprises four bearings 7(*a*), 7(*b*), 7(*c*), 7(*d*) mounted laterally on its two angled surfaces 9(*a*) and 9(*b*). The two bearings 7(*a*), 7(*b*) are mounted on the angled surface 9(*a*) and two bearings 7(*c*), 7(*d*) are mounted on the angled surface 9(*b*).

Also, there can be other configurations possible for the lifting unit 3, i.e. the lifting unit 3 can have any number of bars and bearings depending upon the configuration required for the capacity of the load being lifted.

In another embodiment of the invention, the bearings 6(*a*), 6(*b*), 6(*c*), 6(*d*), 7(*a*), 7(*b*), 7(*c*), 7(*d*) work similarly to the mechanism of linear bearings.

In another embodiment of the invention, the number of bearings 6(*a*), 6(*b*), 6(*c*), 6(*d*), 7(*a*), 7(*b*), 7(*c*), 7(*d*) mounted on each angle bar 8, 9 can be increased or decreased to improve the functionality of the load lifting assembly 1.

In still another embodiment of the invention, the geometry of the bars 8, 9 can be changed to suit the design of the pole 2 without departing from the scope and the spirit of the invention.

In still another embodiment of the invention, the bearings 6(*a*), 6(*b*), 6(*c*), 6(*d*), 7(*a*), 7(*b*), 7(*c*), 7(*d*) can be replaced by rollers fixed on the bars 8, 9 by nuts and bolts.

In still another embodiment of the invention, the bearings 6(*a*), 6(*b*), 6(*c*), 6(*d*), 7(*a*), 7(*b*), 7(*c*), 7(*d*) can be replaced by gears having teeth engaged with the pole 2 surface.

Figure 4:
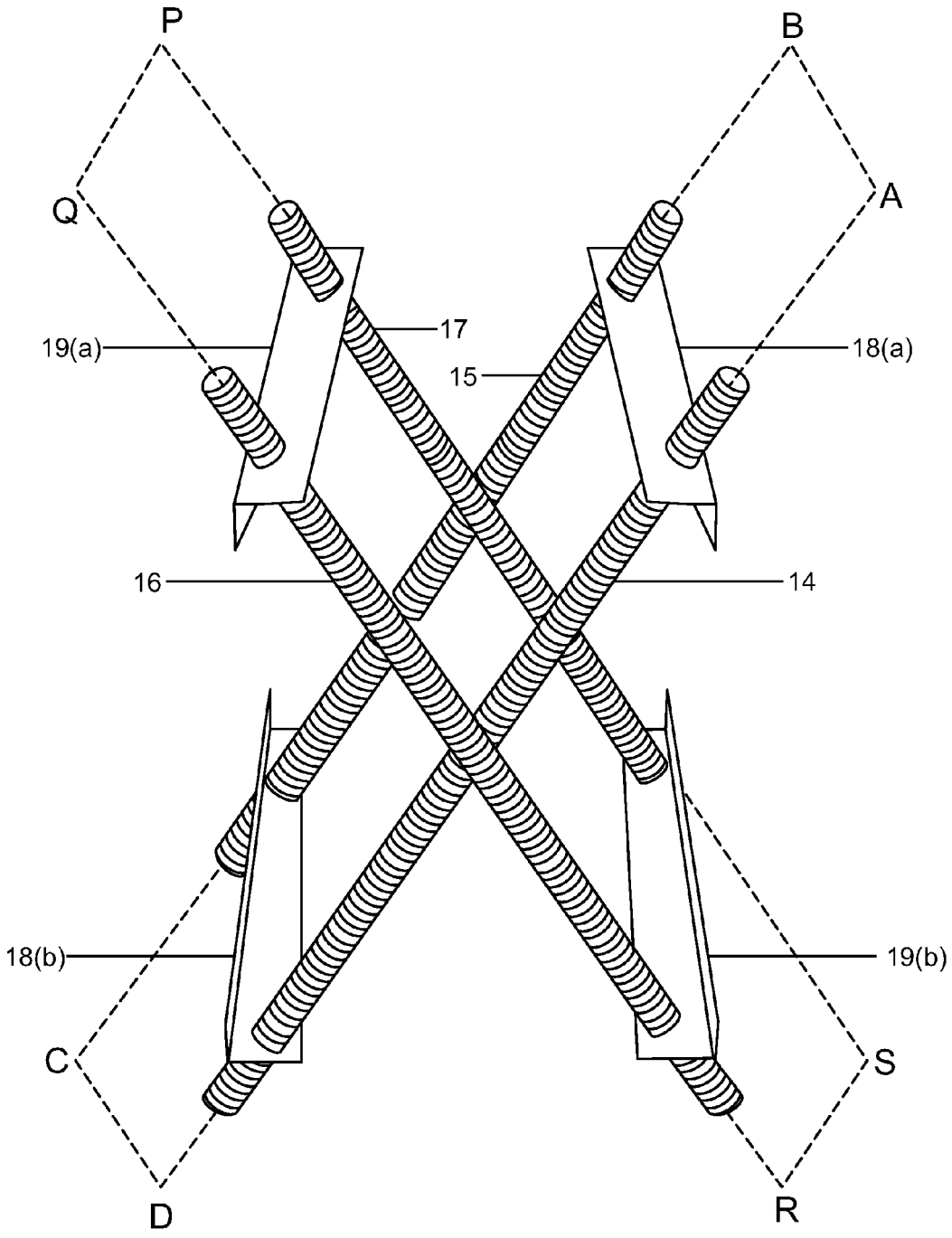
FIG. 4 illustrates the perspective view of the screws and connectors.

In still another embodiment of the invention, as depicted in FIG. 4 the lifting unit 3 further comprises a plurality of first screws 14, 15 in a first plane ABCD, a plurality of second screws 16, 17 in a second plane PQRS, a pair of first connectors 18(*a*),18(*b*) connected proximately to the opposite ends of each of the first screws 14, 15 and a pair of second connectors 19(*a*), 19(*b*) connected proximately to the opposite ends of each of the second screws 16, 17. The first screws 14, 15 lying in a first plane ABCD are in an inter-crossing arrangement with the second screws 16, 17 lying in a second plane PQRS wherein the first plane ABCD crosses the second plane PQRS. The first connector 18(*a*) is fixed proximately at the top end of the first screws 14, 15 and the first connector 18(*b*) is fixed proximately at the bottom end of the first screws 14, 15. Similarly, the second screws 16, 17 consists of a pair of second connectors 19(*a*), 19(*b*) wherein the second connector 19(*a*) is fixed proximately at the top end of the second screws 16,17 and the second connector 19(*b*) is fixed proximately at the bottom end of the second screws 16, 17. The connectors 18(*a*), 18(*b*), 19(*a*), 19(*b*) can be angle bars.

The framework of the inter-crossing screws 14,15,16,17 and connectors 18(*a*),18(*b*),19(*a*),19(*b*) serve two functions, firstly they secure the plurality of bearings 6(*a*), 6(*b*), 6(*c*), 6(*d*), 7(*a*), 7(*b*), 7(*c*), 7(*d*) to the pole 2 and secondly, they create a counter action on both sides of the bearings 6(*a*), 6(*b*), 6(*c*), 6(*d*), 7(*a*), 7(*b*), 7(*c*), 7(*d*) when loads are present, making the load lifting assembly 1 to slide up and down the pole 2 with the load attached.

In still another embodiment of the invention, the first screws 14, 15 and second screws 16, 17 can be high tension screws.

In still another embodiment of the invention, the connectors 18(*a*), 18(*b*), 19(*a*), 19(*b*) are pins clamped to the screws 14, 15, 16, 17 at their respective ends without departing from the scope and the spirit of the invention.

In still another embodiment of the invention, the number of screws lying in respective planes can be increased according to the load being lifted by the load lifting assembly 1.

In still another embodiment of the invention, there can be more than two planes comprising a plurality of screws disposed in each plane.

In still another embodiment of the invention, the load transporting unit 4 is a horizontal platform comprising two bars 4(*a*) and 4(*b*) on which any type of load can be placed. The motive force to the load lifting assembly 1 is provided by a driving unit 5. The driving unit 5 comprises three pulleys 22(*a*), 22(*b*), and 22(*c*) and a motor 23 so as to drive the lifting unit 3 longitudinally along the pole 2 to lift the load. The lifting unit 3 is mounted on the pole 2 and is coupled with the load transporting unit 4 as shown in FIG. 1.

Figure 5:
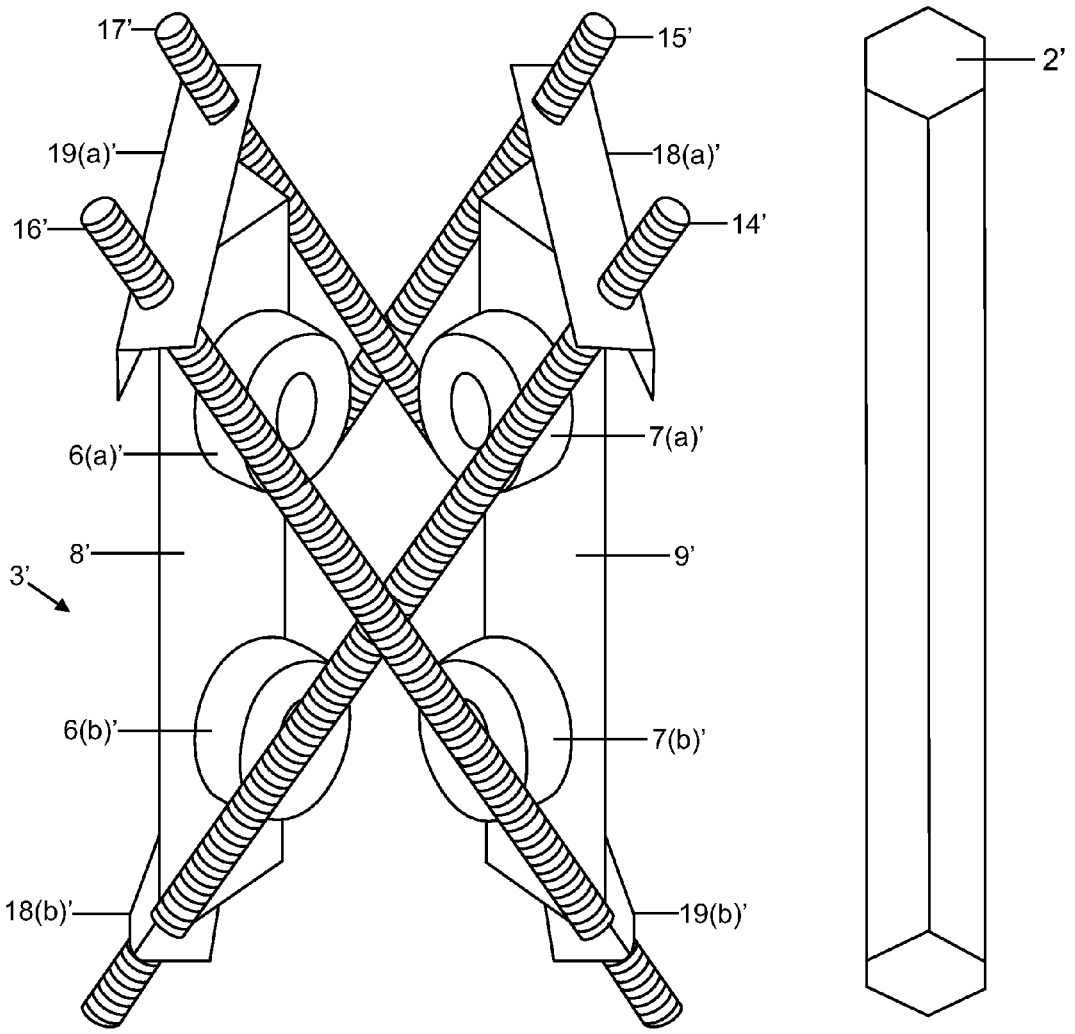
FIG. 5 illustrates the movable unit and the fixed pole.

In still another embodiment as illustrated in FIG. 5, the invention relates to an assembly comprising a fixed pole 2' and a movable unit 3'. The movable unit 3' when installed on the pole 2' is capable of moving longitudinally along the pole 2'. The movable unit 3' comprises a plurality of bars 8', 9' and a plurality of bearings 6(*a*)', 6(*b*)', 6(*c*)' (not shown), 6(*d*)' (not shown), 7(*a*)', 7(*b*)', 7(*c*)' (not shown), 7(*d*)' (not shown). The bearings 6(*a*)', 6(*b*)', 6(*c*)' (not shown), 6(*d*)' (not shown) are mounted laterally on the bar 8' and the bearings 7(*a*)', 7(*b*)', 7(*c*)' (not shown), 7(*d*)' (not shown) are mounted laterally on the bar 9'. Further, all the eight bearings 6(*a*)', 6(*b*)', 6(*c*)', 6(*d*)', 7(*a*)', 7(*b*)', 7(*c*)', 7(*d*)' are in contact with the pole 2' and the contact pressure of the bearings contacting the pole is adjustable. The movable unit 3' further comprises a plurality of first screws 14', 15' in a first plane a plurality of second screws 16', 17' in a second plane, a pair of first connectors 18(*a*)',18(*b*)' connected proximately to the opposite ends of each of the first screws 14', 15' and a pair of second connectors 19(*a*)', 19(*b*)' connected proximately to the opposite ends of each of the second screws 16', 17'. The first screws 14', 15' and the second screws 16', 17' can be high tension screws and the first connectors 18(*a*)', 18(*b*)' and the second connectors 19(*a*)', 19(*b*)' can be angle bars. Further, a driving unit can be coupled to the movable unit 3' to drive the movable unit 3' along the pole 2'.

In still another embodiment of the invention, the fixed pole 2 and 2' can be fixed longitudinally, laterally or at an inclination to the ground.

Figure 6:
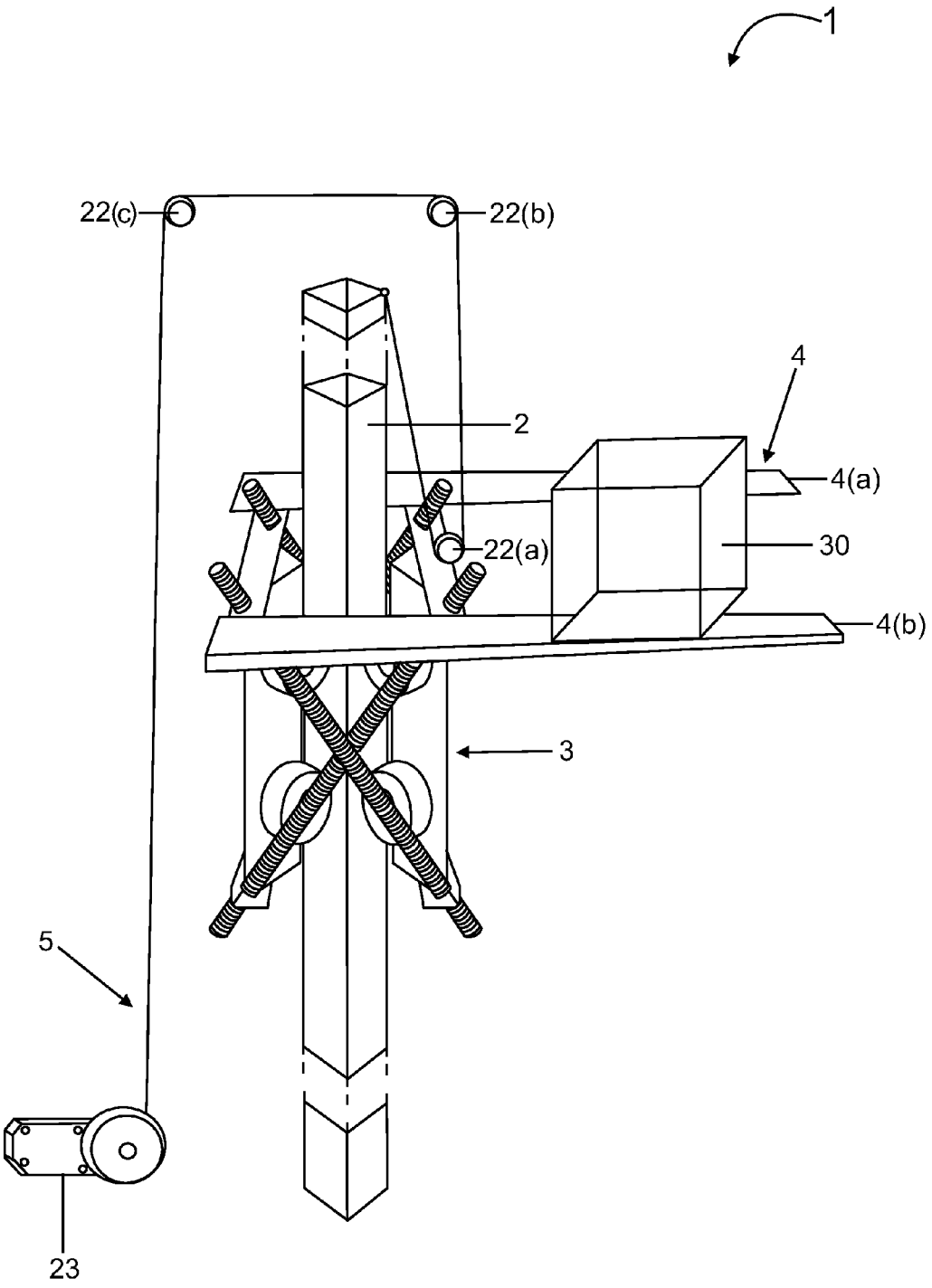
FIG. 6 illustrates the load lifting assembly with a load placed on the load transporting unit.

The invention also relates to a load lifting mechanism for lifting a load 30 with the help of load lifting assembly 1. FIG. 6 illustrates any load for e.g. a box 30 being placed on the bar 4(*b*) of the load transporting unit 4. The box 30 can be placed without any support or with a supporting member like a clamping belt can be attached to the box 30 so as to hold the box 30 in its position while the load transporting unit 4 is in motion. The motor 23 provides the motive force which is transferred to the load lifting assembly 4 with the help of pulleys 22(*a*), 22(*b*), and 22(*c*). The motive force provided by the motor 23 lifts the load transporting unit 4 longitudinally along the pole 2 with the plurality of bearings 6(*a*), 6(*b*), 6(*c*), 6(*d*), 7(*a*), 7(*b*), 7(*c*), 7(*d*) contacting the pole 2. The contact pressure of the plurality of bearings 6(*a*), 6(*b*), 6(*c*), 6(*d*), 7(*a*), 7(*b*), 7(*c*), 7(*d*) with the pole 2 is adjustable by the inter-crossing framework of the first screws 14, 15, first connectors 18(*a*),18(*b*), second screws 16, 17 and second connectors 19(*a*), 19(*b*). While the lifting unit 3 is in motion, the bearings 6(*a*), 6(*b*), 6(*c*), 6(*d*), 7(*a*), 7(*b*), 7(*c*), 7(*d*) slide against the pole 2 and the load transporting unit 4 lifts the box 30.

In an exemplary embodiment of the invention, a braking system is incorporated in the load lifting assembly 1 so as to provide braking characteristics for sudden and impulsive stops of the lifting unit 3 along the pole 2.

In still another embodiment of the invention, the load transporting unit 4 is a hook or a clamping means to which the load to be transported is attached.

In still another embodiment of the invention, the driving unit 5 is selected from a group comprising of but not limited to electrical, pneumatic, hydraulic and mechanical units.

In still another embodiment of the invention, the load transporting unit 4 can have various shapes and sizes with respect to the load capacity and load to be lifted without departing from the scope and the spirit of the invention.

In still another embodiment of the invention, various types of materials but not limited to steel, stainless steel, aluminum or iron can be used to manufacture the components of the lifting assembly 1 to create a superior and stronger assembly. The selection of materials is based upon the availability, economy and the strength required for the load lifting assembly 1.

The load lifting assembly 1 of the invention is easy to assemble and simple to mount. The materials used in the load lifting assembly 1 are easily available and low cost. The dimensions of the various elements of load lifting assembly 1 can be modified according to the load lifting capacity thus providing the load lifting assembly 1 with broader lifting capacity and flexibility. The load lifting assembly 1 can be used in various industries, such as but not limited to various ports for loading goods, cargo handling in airport, textile, in supermarkets, mechanical, civil, cargo, automotive, the plastic industry, the woodworking industry, the foodstuffs industry and the drinks industry or the like where lifting and transporting of loads is required.

It is noted that the foregoing has outlined some of the more pertinent objects and embodiments of the present invention. This invention may be used for many applications. Thus, although the description is made for particular arrangements and methods, the intent and concept of the invention is suitable and applicable to other arrangements and applications. It will be clear to those skilled in the art that modifications to the disclosed embodiments can be effected without departing from the spirit and scope of the invention. The described embodiments ought to be construed to be merely illustrative of some of the more prominent features and applications of the invention. Other beneficial results can be realized by applying the disclosed invention in a different manner or modifying the invention in ways known to those familiar with the art.

What is claimed is:

1. A load lifting assembly, comprising:
- a fixed pole;
- a lifting unit capable of moving longitudinally along the pole, wherein the lifting unit comprises:
  - a plurality of bars;
  - a plurality of bearings mounted laterally on the bars, wherein the bearings contact the pole;
  - a plurality of first screws disposed in a first plane;
  - a plurality of second screws disposed in a second plane;
  - a pair of first connectors, wherein the pair of first connectors are connected proximately to the opposite ends of each of the first screws;
  - a pair of second connectors, wherein the pair of second connectors are connected proximately to the opposite ends of each of the second screws;
- a load transporting unit coupled to the lifting unit; and
- a driving unit, wherein the driving unit drives the load transporting unit.

2. The load lifting assembly according to claim 1, wherein the bars are angle bars.

3. The load lifting assembly according to claim 1, wherein the first screws and the second screws are high tension screws.

4. The load lifting assembly according to claim 1, wherein the first plane and the second plane cross each other.

5. The load lifting assembly according to claim 1, wherein the first connectors and the second connectors are angle bars.

6. The load lifting assembly according to claim 1, wherein contact pressure of the bearings contacting the pole is adjustable.

7. The load lifting assembly according to claim 1, wherein the driving unit is selected from a group comprising of electrical, pneumatic, hydraulic and mechanical units.

8. An assembly, comprising:
- a fixed pole; and
- a movable unit capable of moving longitudinally along the pole, wherein the movable unit comprises:
  - a plurality of angle bars;
  - a plurality of bearings mounted laterally on the bars, wherein the bearings contact the pole;
  - a plurality of first screws disposed in a first plane;
  - a plurality of second screws disposed in a second plane, wherein the first plane and the second plane cross each other;
  - a pair of first connectors, wherein the pair of first connectors are connected proximately to the opposite ends of each of the first screws; and
  - a pair of second connectors, wherein the pair of second connectors are connected proximately to the opposite ends of each of the second screws.

9. The assembly according to claim 8, wherein the first screws and the second screws are high tension screws.

10. The assembly according to claim 8, wherein the first connectors and the second connectors are angle bars.

11. The assembly according to claim 8, wherein contact pressure of the bearings contacting the pole is adjustable.

12. The assembly according to claim 8, wherein a driving unit can be coupled to the movable unit to drive the movable unit along the pole.

13. A load lifting mechanism for lifting a load, comprising:
- placing the load on a load transporting unit attached to a lifting unit, wherein the lifting unit comprises a plurality of bars with a plurality of bearings mounted thereon and an inter-crossing arrangement comprising a plurality of first screws disposed in a first plane and a plurality of second screws disposed in a second plane, wherein a pair of first connectors is connected proximately to the opposite ends of each of the first screws and a pair of second connectors is connected proximately to the opposite ends of each of the second screws;

moving the lifting unit longitudinally along a fixed pole with the bearings mounted laterally on the bars, wherein the bearings contact the pole; and driving the load transporting unit by a driving unit to lift the load.

14. The load lifting mechanism according to claim 13, wherein the load transporting unit comprises at least one horizontal platform.

15. The load lifting mechanism according to claim 13, wherein contact pressure of the bearings contacting the pole is adjustable.

16. The load lifting mechanism according to claim 13, wherein the driving unit is selected from a group comprising of electrical, pneumatic, hydraulic and mechanical units.

* * * * *